US007934792B2

(12) United States Patent
Kumagai et al.

(10) Patent No.: US 7,934,792 B2
(45) Date of Patent: May 3, 2011

(54) LIQUID CONTAINER

(75) Inventors: Toshio Kumagai, Nagano (JP); Atsushi Kobayashi, Nagano (JP); Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 104 days.

(21) Appl. No.: 12/186,156

(22) Filed: Aug. 5, 2008

(65) Prior Publication Data

US 2008/0291242 A1 Nov. 27, 2008

Related U.S. Application Data

(62) Division of application No. 11/391,943, filed on Mar. 29, 2006.

(30) Foreign Application Priority Data

| | | |
|---|---|---|
| Mar. 30, 2005 | (JP) | 2005-098704 |
| Mar. 30, 2005 | (JP) | 2005-098787 |
| Mar. 30, 2005 | (JP) | 2005-098816 |
| Mar. 30, 2005 | (JP) | 2005-098931 |
| Feb. 24, 2006 | (JP) | 2006-048694 |
| Feb. 24, 2006 | (JP) | 2006-048711 |

(51) Int. Cl.
*B41J 2/165* (2006.01)

(52) U.S. Cl. ..... 347/36

(58) Field of Classification Search ..... 347/36
See application file for complete search history.

(56) References Cited

U.S. PATENT DOCUMENTS

| | | | | |
|---|---|---|---|---|
| 4,695,824 | A * | 9/1987 | Tazaki | 347/86 |
| 5,367,328 | A | 11/1994 | Erickson | |
| 5,621,450 | A * | 4/1997 | Kawai et al. | 347/108 |
| 5,790,158 | A | 8/1998 | Shinada et al. | |
| 5,856,834 | A | 1/1999 | Murphy, III | |
| 6,203,137 | B1 * | 3/2001 | Niimura et al. | 347/36 |
| 6,250,746 | B1 | 6/2001 | Ito et al. | |
| 6,672,704 | B2 * | 1/2004 | Katakura et al. | 347/23 |

(Continued)

FOREIGN PATENT DOCUMENTS

| | | |
|---|---|---|
| CN | 2492386 | 5/2002 |

(Continued)

OTHER PUBLICATIONS

International Search Report from PCT Patent Appln. PCT/JP2006/304743, dated Jun. 13, 2006.

*Primary Examiner* — Julian D Huffman
*Assistant Examiner* — Jason S Uhlenhake
(74) *Attorney, Agent, or Firm* — Stroock & Stroock & Lavan LLP

(57) ABSTRACT

A liquid container of the invention has a container body including a storage space and a liquid feed port and a liquid injection port which are installed on the container body. The liquid feed port is structured so as to interconnect the storage space and the liquid ejecting head with each other, when the liquid container is mounted on a liquid ejecting unit. The liquid injection port is structured so as to interconnect the storage space of the container body and a liquid tank of a stationary unit with each other, when the liquid ejecting unit is united with the stationary unit. The invention provides a liquid container effective in realization of a liquid ejecting apparatus which can meet two needs for executing a large amount of printing and transporting when necessary.

5 Claims, 11 Drawing Sheets

U.S. PATENT DOCUMENTS

| | | | | |
|---|---|---|---|---|
| 6,742,887 | B2 | 6/2004 | Ando | |
| 6,783,215 | B2 * | 8/2004 | Yoshida et al. | 347/85 |
| 2002/0101489 | A1 | 8/2002 | Okamoto et al. | |
| 2004/0050974 | A1 | 3/2004 | Lee et al. | |
| 2004/0061765 | A1 | 4/2004 | Kan et al. | |
| 2004/0233260 | A1 | 11/2004 | Shinada et al. | |

FOREIGN PATENT DOCUMENTS

| | | |
|---|---|---|
| JP | 63-013749 | 1/1988 |
| JP | 08-276576 | 10/1996 |
| JP | 11-157099 | 6/1999 |
| JP | 2003-159815 | 6/2003 |
| JP | 2005-074627 | 3/2005 |

* cited by examiner

LIQUID CONTAINER

CROSS REFERENCE TO RELATED APPLICATIONS

This application is a divisional of copending application Ser. No. 11/391,943, filed on Mar. 29, 2006, the entire contents of which are incorporated herein by reference.

This application is based upon the prior Japanese Patent Applications Nos. 2005-98704, 2005-98787, 2005-98816 and 2005-98931, all of which were filed on Mar. 30, 2005, and Japanese Patent Applications Nos. 2006-48694 and 2006-48711, both of which were filed on Feb. 24, 2006, the entire contents of which are incorporated herein by reference.

BACKGROUND OF THE INVENTION

1. Field of the Invention

The present invention relates to a liquid container removably mounted on a portable liquid ejecting unit having a liquid ejecting head for ejecting a liquid to an object.

The present invention relates to a liquid container removably mounted on a liquid ejecting apparatus having a liquid ejecting head for ejecting a liquid to an object.

The present invention relates to a waste liquid collection container for collecting a waste liquid sucked and ejected from the liquid ejecting head of the liquid ejecting apparatus, a waste liquid ejecting method from the container, and a cartridge equipped with the container.

2. Description of the Related Art

As a representative example of the conventional liquid ejecting apparatus, there is an ink jet recording apparatus having an ink jet recording head for image recording. As other liquid ejecting apparatuses, for example, an apparatus having a coloring material ejecting head used to manufacture color filters such as a liquid crystal display, an apparatus having an electrode material (conductive paste) ejecting head used to form electrodes such as an organic EL display and a face emission display (FED), an apparatus having a biological organic substance ejecting head used to manufacture biological chips, and an apparatus having a sample ejecting head as a precise pipette may be cited.

The ink jet recording apparatus which is a representative example of the liquid ejecting apparatus produces a comparatively low noise during printing and can form small dots in high density, so that in recent years, it is used for various printing including color printing.

As a liquid feed method for the liquid ejecting apparatus represented by the ink jet recording apparatus, there is an available method for feeding a liquid from a liquid container storing a liquid to the liquid ejecting apparatus. Furthermore, in the liquid feed method by the liquid container, to simply exchange the liquid container by a user when the liquid in the liquid container is consumed, the liquid container is generally formed as a cartridge installed removably on the liquid ejecting apparatus.

Generally, the ink jet recording apparatus has a carriage having a recording head for ejecting ink drops for moving back and forth along the recording face of a recording medium (an object). As an ink feed method from the ink cartridge to the recording head, there is an available method for mounting the ink cartridge on the carriage and feeding ink from the ink cartridge moving back and forth together with the recording head to the recording head (the so-called on-carriage method). As another method, there is an available method for mounting the ink cartridge in the casing of the apparatus body and feeding ink from the ink cartridge via an ink flow path formed by a flexible tube to the recording head (the so-called off-carriage system).

User's needs relating to the status in use of the ink jet recording apparatus are widely diversified, and there is a need for an ink jet recording apparatus for continuously performing a comparatively large amount of printing process, and on the other hand, there is also a need for a portable ink jet recording apparatus which is handy, small, and light in weight.

Therefore, if there is an available ink jet recording apparatus which can meet two needs for executing a large amount of printing and transporting when necessary, it is very convenient.

However, in the ink jet recording apparatus suited for a large mount of printing, an ink cartridge having a large capacity and a suction pump having a large capacity for sucking and ejecting ink from the recording head are necessary and the whole recording apparatus becomes comparatively large and greatly heavy. Therefore, it is very difficult to manufacture an ink jet recording apparatus suited for a large amount of printing in a small and light state.

Further, the portable ink jet recording apparatus must be made small and light to realize convenient transport, so that it is necessary to use a compact ink cartridge and suction pump, thus the ink cartridge and suction pump are inevitably reduced in capacity. Therefore, it is also very difficult to manufacture a portable ink jet recording apparatus in a state suitable for a large mount of printing.

Further, the stationary ink jet recording apparatus, compared with a portable ink jet recording apparatus, can easily adopt an ink cartridge having a comparatively large capacity and particularly, a stationary and off-carriage type ink jet recording apparatus can easily adopt a large-capacity cartridge. However, depending on the use object of a user, there still is a possibility that a sufficient ink amount cannot be reserved. Therefore, it is desirable to be able to supply properly ink when necessary.

Further, when supplying ink to the ink cartridge, it is desirable to keep the ink cartridge be mounted on the ink jet recording apparatus during ink supply. On the other hand, regardless of existence of necessity of ink supply, if a supply device for ink supply is always kept connected to the ink cartridge, useless occupation of the installation space will result undesirably.

Therefore, it is desirable to simply connect the supply device for ink supply to the ink cartridge only when necessary. Moreover, when the supply device for ink supply is removed from the ink cartridge, it is desired to simply ensure the sealability of the storage space in the ink cartridge.

Furthermore, even if an ink cartridge capable of smoothly supplying ink can be manufactured, if the manufacturing cost is increased greatly compared with the conventional ink cartridge, the value as a product is halved. Further, it is also requested to suppress not only the manufacturing cost of the ink cartridge but also the manufacturing cost relating to the supply device for supplying ink to the ink cartridge as low as possible.

Further, the portable ink jet recording apparatus must be made small and light to realize convenient transport, so that it is necessary to use a compact ink cartridge and suction pump, thus the ink cartridge and suction pump are inevitably reduced in capacity. Therefore, it is also very difficult to manufacture a portable ink jet recording apparatus in a state suitable for a large mount of printing.

Furthermore, in the ink jet recording apparatus, at time of the initial filling of ink to the recording head and at time of the cleaning operation for eliminating of clogging of the nozzle of the recording head, ink is sucked and ejected from the recording head and it is necessary to appropriately collect an ejected waste liquid.

However, the portable ink jet recording apparatus, as mentioned above, is required to realize miniaturization and lightweight, so that it is difficult to install a large-capacity collection container to collect a waste liquid. Therefore, in the portable ink jet recording apparatus, there is a possibility that a waste liquid may overflow the collection container when in use.

Furthermore, not only in the portable ink jet recording apparatus but also in the stationary ink jet recording apparatus, if a waste liquid collected by the collection container is ejected appropriately and the storage capacity of the collection container can be recovered, it is very convenient.

SUMMARY OF THE INVENTION

The present invention of a first aspect was developed with the foregoing in view and is intended to provide a liquid container effective in realization of a liquid ejecting apparatus which can meet two needs for executing a large amount of printing and transporting when necessary.

The present invention of a second aspect was developed with the foregoing in view and is intended to provide a liquid container for appropriately mounting or demounting a supply device for supplying a liquid when necessary in the state that the liquid container is mounted on a liquid ejecting apparatus, and particularly is intended to provide a liquid container effective in realization of a liquid ejecting apparatus which can meet two needs for executing a large amount of printing and transporting when necessary.

The present invention of a third aspect was developed with the foregoing in view and is intended to provide a liquid container for appropriately mounting or demounting a supply device for supplying a liquid when necessary in the state that the liquid container is mounted in a liquid ejecting apparatus and moreover avoiding a great rise in the manufacturing cost compared with the conventional one, and particularly is intended to provide a liquid container effective in realization of a liquid ejecting apparatus which can meet two needs for executing a large amount of printing and transporting when necessary.

The present invention of a fourth aspect was developed with the foregoing in view and is intended to provide a waste liquid collection container for collecting a waste liquid sucked and ejected from a liquid ejecting head of a liquid ejecting apparatus which can appropriately eject a collected waste liquid from the inside thereof, thereby recovering the storage capacity thereof.

Particularly, the present invention of the fourth aspect is intended to provide a waste liquid collection container effective in realization of a liquid ejecting apparatus having a desired waste liquid collection function necessary to meet two needs for executing a large amount of printing and transporting when necessary, a waste liquid ejection method from the container, and a cartridge having the container.

To solve the above problems, the present invention of the first aspect is a liquid container adapted to be removably mounted on a portable liquid ejecting unit having a liquid ejecting head for ejecting a liquid toward an object, the portable liquid ejecting unit being able to independently perform a liquid ejection operation to the object by itself and also being mounted on and separably united with a stationary unit having a liquid tank storing a liquid to be fed to the liquid ejecting head, including: a container body including a storage space for storing a liquid to be fed to the liquid ejecting head; a liquid feed port installed on the container body, the liquid feed port being structured so as to interconnect the storage space of the container body and the liquid ejecting head with each other when the liquid container is mounted on the liquid ejecting unit; and a liquid injection port installed on the container body, the liquid injection port being structured so as to interconnect the storage space of the container body and the liquid tank of the stationary unit with each other when the liquid ejecting unit is united with the stationary unit.

Preferably, the liquid feed port is structured so that a liquid feed needle installed on the liquid ejecting unit is inserted therein when the liquid container is mounted on the liquid ejecting unit. The liquid injection port is structured so that a liquid injection needle installed on the stationary unit is inserted therein when the liquid ejecting unit is united with the stationary unit.

Preferably, the liquid injection port is arranged on an axis of an insertion direction of the liquid feed needle into the liquid feed port.

Preferably, when the liquid container is mounted on the liquid ejecting unit and the liquid ejecting unit is not united with the stationary unit, the liquid injection port isolates the storage space of the container body from an outside, and when the liquid ejecting unit is united with the stationary unit, the liquid injection needle installed on the stationary unit is inserted into the liquid injection port.

Preferably, the liquid feed port and the liquid injection port are arranged respectively on a pair of opposite walls composing a part of the container body.

Preferably, the storage space of the container body includes a plurality of storage spaces which are formed in the container body so as to be separated from each other. The liquid feed port and the liquid injection port respectively includes a plurality of liquid feed ports and a plurality of liquid injection ports which are installed in the plurality of storage spaces respectively.

To solve the above problems, the present invention of the second aspect is a liquid container adapted to be removably mounted on a liquid ejecting apparatus having a liquid ejecting head for ejecting a liquid toward an object, the liquid container being structured to be fixed in the liquid ejecting apparatus separately from the liquid ejecting head so that a liquid is fed to the liquid ejecting head via a flexible pipe member, including: a container body including a storage space for internally storing the liquid to be fed to the liquid ejecting head; a liquid feed port installed on the container body, the liquid feed port being structured so as to interconnect the storage space of the container body and the liquid ejecting head with each other when the liquid container is mounted on the liquid ejecting unit; and a liquid injection port installed on the container body so that a liquid injection needle for injecting a liquid into the container body is inserted therein, the liquid injection port being structured so as to isolate the storage space of the container body from an outside when the liquid injection needle is not inserted therein.

Preferably, the liquid feed port is structured so that a liquid feed needle installed on the liquid ejecting apparatus is inserted therein when the liquid container is mounted on the liquid ejecting apparatus.

Preferably, the liquid injection port is arranged on an axis of an insertion direction of the liquid feed needle into the liquid feed port.

Preferably, the liquid feed port and the liquid injection port are arranged respectively on a pair of opposite walls composing a part of the container body.

Preferably, the storage space of the container body includes a plurality of storage spaces which are formed in the container body so as to be separated from each other. The liquid feed port and the liquid injection port respectively includes a plurality of liquid feed ports and a plurality of liquid injection ports which are installed in the plurality of storage spaces respectively.

To solve the above problems, the present invention of the third aspect is a liquid container adapted to be removably mounted on a liquid ejecting apparatus having a liquid ejecting head for ejecting a liquid toward an object, including: a container body including a storage space for internally storing a liquid to be fed to the liquid ejecting head; and a pair of liquid flow ports installed on the container body, the pair of liquid flow ports having a common structure and common dimensions, the pair of liquid flow ports being structured so that the storage space of the container body is isolated from an outside when the liquid container is not mounted on the liquid ejecting apparatus, and the storage space of the container body and the liquid ejecting head are interconnected with each other when the liquid container is mounted on the liquid ejecting apparatus so that a liquid feed needle installed on the liquid ejecting apparatus is inserted into either of the pair of liquid flow ports.

Preferably, the pair of liquid flow ports are respectively arranged on a pair of opposite walls composing a part of the container body.

Preferably, the pair of liquid flow ports are arranged on an axis of an insertion direction of the liquid feed needle into the either of the pair of liquid flow ports.

Preferably, the storage space of the container body includes a plurality of storage spaces which are formed in the container body so as to be separated from each other. The pair of liquid flow ports includes a plurality of pairs of liquid flow ports which are installed in the plurality of storage spaces respectively.

To solve the above problems, the present invention of the fourth aspect is a waste liquid collection container for collecting a waste liquid sucked and ejected from a liquid ejecting head of a liquid ejecting apparatus, including: a container body having at least a part formed by a flexible container wall; a flexible liquid absorber installed inside the container body; a waste liquid injection port through which a waste liquid sucked and ejected from the liquid ejecting head is injected into the container body; and a waste liquid ejection port through which a liquid from an inside of the container body is ejected. The waste liquid collection container is structured so that an inner pressure of the container body becomes negative in correspondence with an ejection of the liquid through the waste liquid ejection port, thereby the flexible container wall is deformed and a volume of the container body is reduced so that the liquid absorber is contracted.

Preferably, the waste liquid ejection port is arranged on an axis of an insertion direction of a waste liquid injection needle into the waste liquid injection port.

Preferably, the waste liquid collection container is structured as a cartridge removably mounted on the liquid ejecting apparatus.

To solve the above problems, the present invention of the fourth aspect is a waste liquid ejection method of ejecting a waste liquid inside a waste liquid collection container mentioned above, including: sucking the inside of the container body through the waste liquid ejection port in a state that a flow path on a side of the waste liquid injection port is blocked so as to make the inner pressure of the container body negative; and contracting the flexible liquid absorber so that a waste liquid is ejected from the inside of the container body through the waste liquid ejection port.

To solve the above problems, the present invention of the fourth aspect is a cartridge including: a waste liquid collection container mentioned above; and a liquid container united with the container body of the waste liquid collection container, the liquid container having a container body internally storing a liquid to be fed to the liquid ejecting head.

According to the present invention of the first aspect, a liquid container effective in realization of a liquid ejecting apparatus which can meet two needs for executing a large amount of printing and transporting when necessary can be provided.

Further, the present invention of the second aspect can provide a liquid container to which a supply device for supplying a liquid to the liquid container can be appropriately connected when necessary in the state that the liquid container is mounted on a liquid ejecting apparatus, and particularly a liquid container effective in realization of a liquid ejecting apparatus which can meet two needs for executing a large amount of printing and transporting when necessary.

Further, the present invention of the third aspect can provide a liquid container to which a supply device for supplying a liquid to the liquid container can be appropriately connected when necessary in the state that the liquid container is mounted on a liquid ejecting apparatus, and moreover, which can avoid a great rise in the manufacturing cost compared with the conventional one, and particularly a liquid container effective in realization of a liquid ejecting apparatus which can meet two needs for executing a large amount of printing and transporting when necessary.

Further, according to the present invention of the fourth aspect, in a waste liquid collection container for collecting a waste liquid sucked and ejected from a liquid ejecting head of a liquid ejecting apparatus, a waste liquid collected by the waste liquid collection container can be appropriately ejected from the container, thereby the storage capacity of the container can be recovered.

Particularly, the present invention of the fourth aspect functions very effectively to realize a liquid ejecting apparatus having a desired waste liquid collection function necessary to meet two needs for executing a large amount of printing and transporting when necessary.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Hereinafter, the ink container to be mounted on the ink jet recording apparatus will be explained as an embodiment of the liquid container according to the present invention with reference to the accompanying drawings.

Further, as an embodiment of the waste liquid collection container according to the present invention and the cartridge having the container, the waste liquid collection container and cartridge which are mounted on the ink jet recording apparatus will be explained with reference to the accompanying drawings.

Furthermore, as an embodiment of the waste liquid ejection method according to the present invention, the waste liquid ejection method from the waste liquid collection container mounted on the ink jet recording apparatus will be explained.

Figure 1:
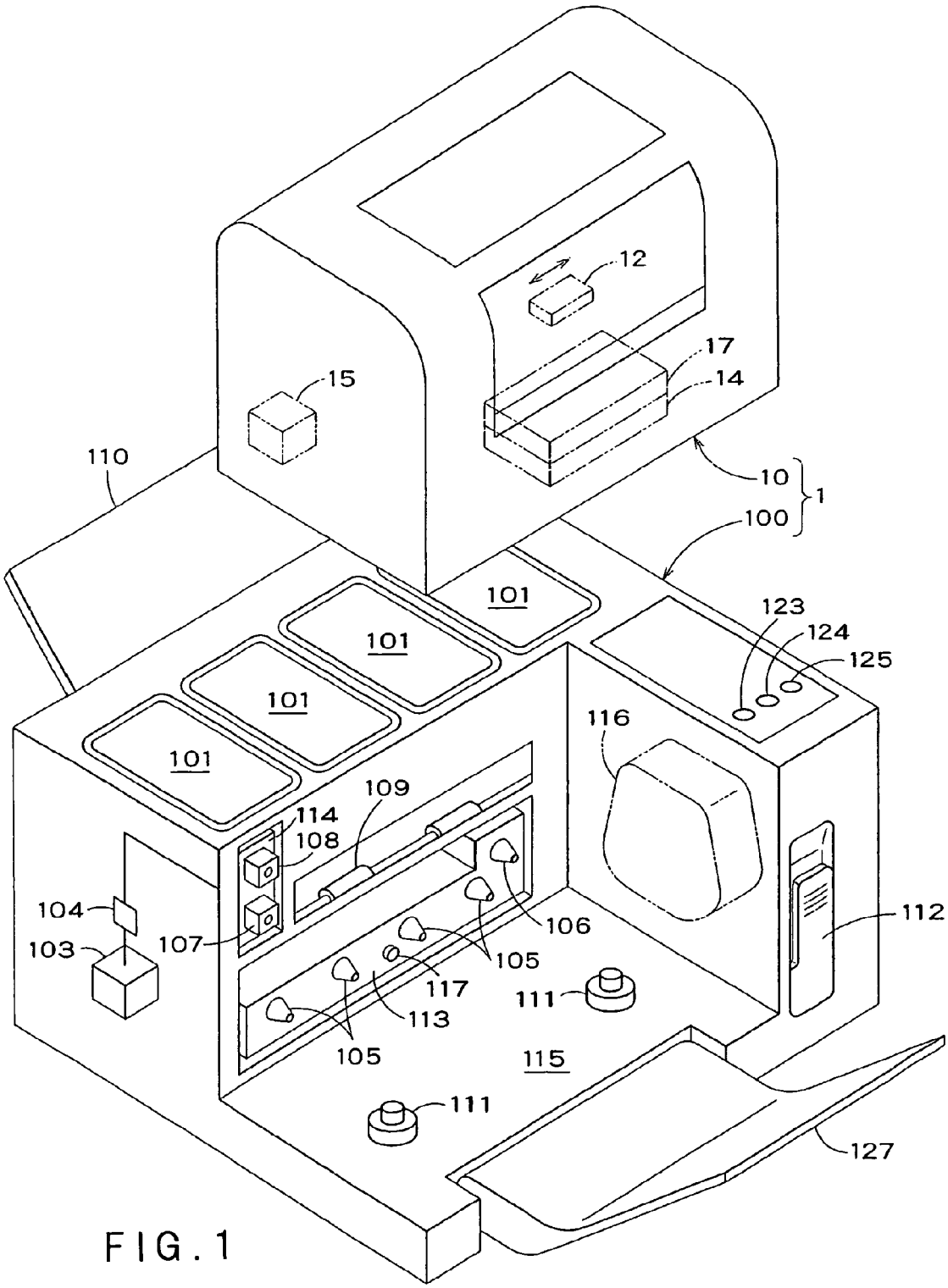
FIG. 1 is a perspective view showing an ink jet recording apparatus having a mounted ink container of an embodiment of a liquid container according to the present invention, showing the condition that an ink jet unit is removed from a cradle unit.
Figure 2:
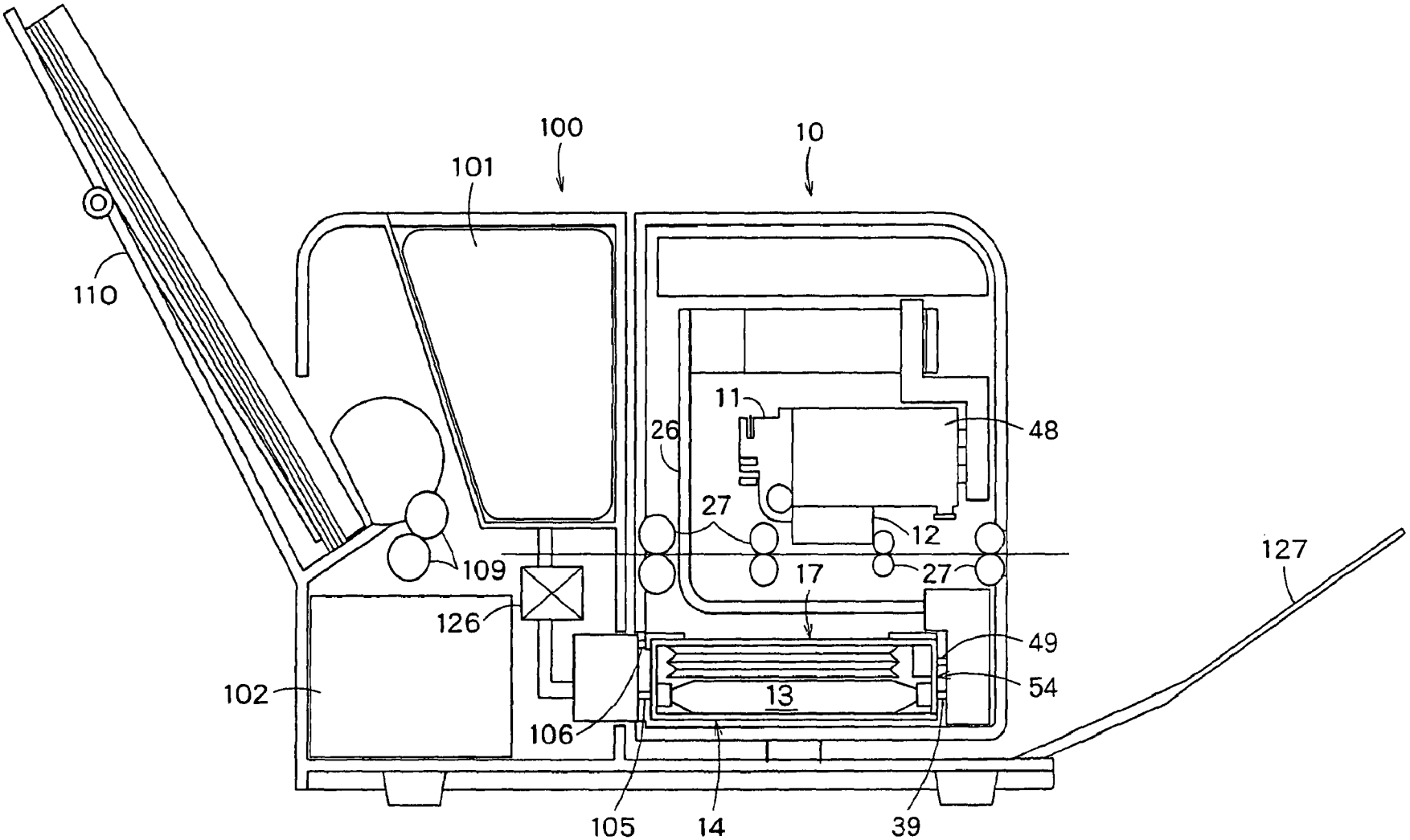
FIG. 2 is a sectional view of the ink jet recording apparatus shown in FIG. 1.

As shown in FIGS. 1 and 2, an ink jet recording apparatus 1 has a portable ink jet unit 10 which is small and light in weight and a stationary cradle unit (stationary unit) 100 where the ink jet unit 10 is loaded and is separably united physically and functionally. The ink jet unit 10 is separated from the cradle unit 100 and can perform independently a printing process and the ink jet unit itself functions as an ink jet recording apparatus.

Figure 3:
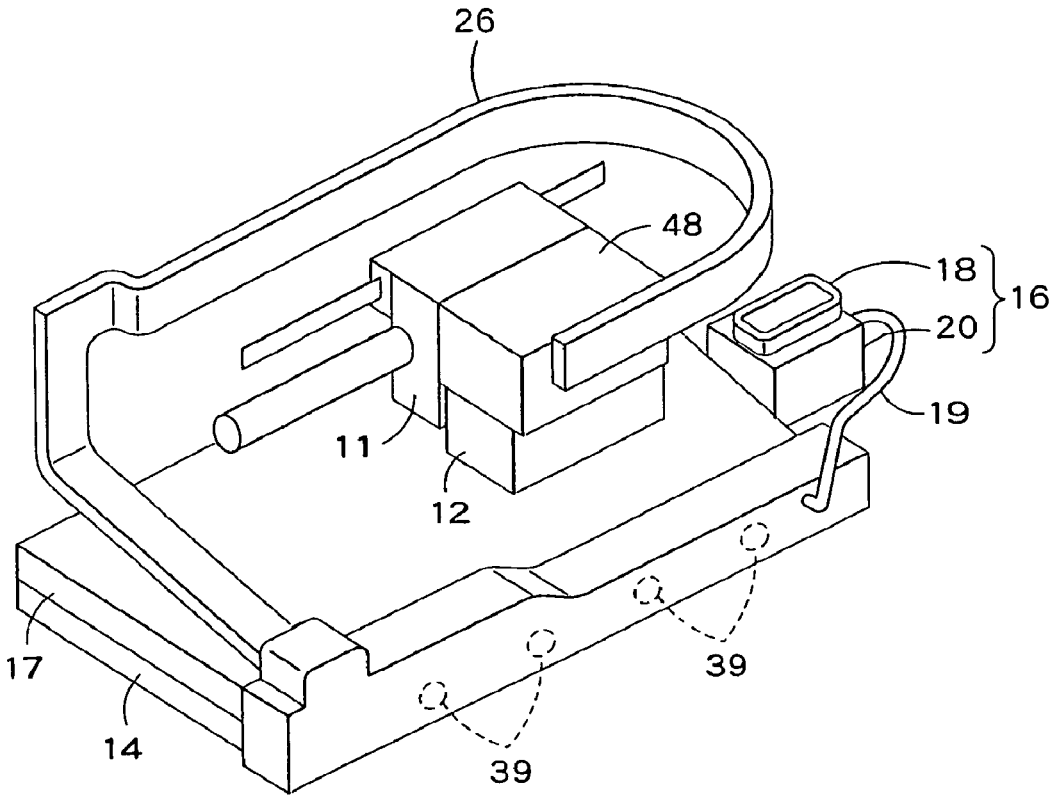
FIG. 3 is a perspective view showing the enlarged essential section of the ink jet recording apparatus shown in FIG. 1.

As shown in FIGS. 1 to 3, the ink jet unit 10 has an ink jet recording head 12 mounted on a carriage 11, an ink container 14 including a storage space 13 for storing ink to be fed to the recording head 12, and a battery 15 for supplying power of the ink jet unit 10.

The recording head 12, while performing an alternating motion together with the carriage 11, ejects ink fed from the ink container 14 toward recording paper (an object) in liquid drops. The ink container 14 is formed as an ink cartridge which can be removably mounted on a cartridge mounting portion of the ink jet unit 10.

For the recording head 12, various conventional recording heads can be used and for example, a conventional type recording head for ejecting ink drops from nozzle openings respectively interconnected to pressure chambers by changing the pressure in the pressure chambers filled with ink by deformation operations of piezo-electric elements.

The portable ink jet unit 10 further has an ink suction means 16 for sucking and ejecting ink from the recording head 12 and a waste liquid collection container 17 for collecting the ink sucked and ejected from the recording head 12 by the ink suction means 16.

The ink suction means 16 includes a cap member 18 for sealing the nozzle forming surface of the recording head 12 during the suction operation and a tube pump 20 connecting to a tube member 19 for connecting the cap member 18 and the waste liquid collection container 17.

As shown in FIG. 3, the ink container 14 and the recording head 12 are interconnected with each other via a flexible tube member 26 for forming a liquid flow path and the ink container 14 is fixed in the ink jet unit 10. Namely, the ink jet unit 10 adopts the so-called off-carriage system regarding the arrangement of the ink container.

On the upper part of the recording head 12, a pressure regulator 48 is installed and the end of the flexible tube member 26 on the ejecting head side is connected to the pressure regulator 48. The pressure regulator 48 functions as a pressure adjustment means for keeping the pressure on the ejecting head side constant regardless of the pressure on the ink container side.

Figure 4:
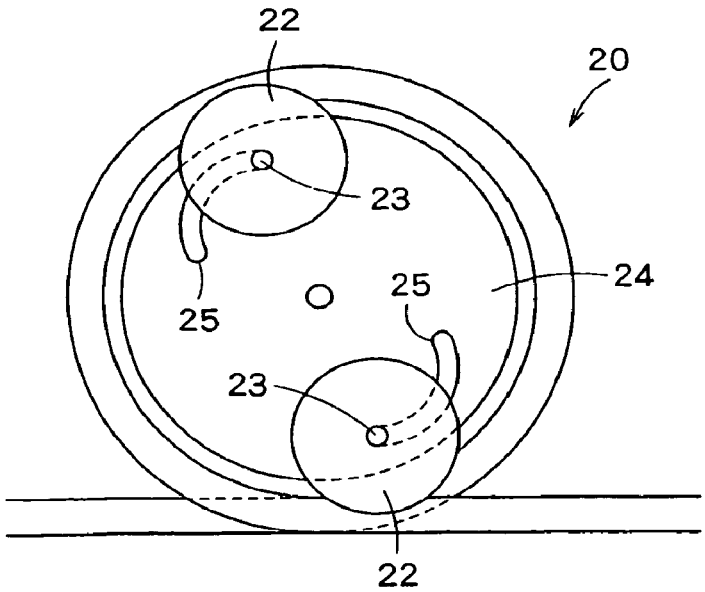
FIG. 4 is a drawing showing an enlarged tube pump of the ink jet recording apparatus shown in FIG. 1.

As shown in FIG. 4, the tube pump 20 includes a pulley 22 for rotating round its axis and revolving round the center with crushing a flexible tube 21. A rotation shaft 23 of the pulley 22 is inserted slidably through a curved guide hole 25 formed on a rotary plate 24.

And, when the rotary plate 24 is rotated forward, the pulley 22 is pressed against the flexible tube 21 so that the tube is deformed and enters the interruption state. When the forward rotation of the rotary plate 24 is continued in this state, the pumping function of the tube pump 20 is realized. Even if the forward rotation of the rotary plate 24 is stopped, the interruption state of the tube 21 by the pulley 2 is kept. On the other hand, when the rotary plate 24 is rotated backward, the pulley 22 moves in the direction separating from the flexible tube 21 along the guide hole 25, thus the tube 21 enters the communication state.

As shown in FIG. 2, the cradle unit 100 includes an ink tank 101 for storing ink to be fed to the recording head 12 and a waste liquid collection tank 102 for collecting waste ink ejected from the waste liquid collection container 17. The ink tank 101 is structured as a removable cartridge similarly to the ink container 14, though it has a larger capacity than that of the ink container 14. The waste liquid collection tank 102 has a larger capacity than that of the waste liquid collection container 17.

The ink tank 101 is arranged at a higher location than that of the ink container 14, and when an ink supply valve 126 is opened, ink flows from the ink tank 101 into the ink container 14 by the gravity.

As shown in FIG. 1, the cradle unit 100 has a cradle side power source 103 which is connected to the ink jet unit 10 when the portable ink jet unit 10 is united with the cradle unit 100 and a charging circuit 104 for starting to charge the battery 15 of the ink jet unit 10 when the ink jet unit 10 is united with the cradle unit 100.

The charging condition (during charging or charging completed) of the battery 15 of the ink jet unit 10 is reported by a charging condition indicator 125. On the cradle side display unit including the charging condition indicator 125, a supply condition indicator 123 and a collection condition indicator 124 are also installed.

On the cradle unit 100, when uniting the portable ink jet unit 10 with the cradle unit 100, a plurality of ink injection needles 105 composing a part of the ink tank connection means for enabling liquid communication between the ink tank 101 and the recording head 12 are installed.

Further, on the cradle unit 100, a waste liquid ejection needle 106 composing a part of the waste liquid collection tank connection means for enabling liquid communication between the waste liquid collection container 17 and the waste liquid collection tank 102 when uniting the ink jet unit 10 with the cradle unit 100 is installed.

Furthermore, the cradle unit 100 includes a power source connector 107 for electrically connecting the cradle side power source 103 to the battery 15 of the ink jet unit 10 and an interface connector 108 for transferring signals between the cradle unit 100 and the ink jet unit 10. The power source connector 107 and the interface connector 108, when the ink jet unit 10 is united with the cradle unit 100, are connected respectively to a power source connector 118 and an interface connector 119 which are installed on the back of the ink jet unit 10 shown in FIG. 5.

Further, as shown in FIGS. 1 and 2, the cradle unit 100 includes a paper feed mechanism 109, a paper feed tray 110, and a paper ejection receptor 127. When the ink jet unit 10 is united with the cradle unit 100, a paper feed mechanism 27 of the ink jet unit 10 and the paper feed mechanism 109 of the cradle unit 100 are cooperated. When the ink jet unit 10 is loaded on and united with the cradle unit 100 like this, the recording paper feed and ejection function can be expanded.

Figure 6:
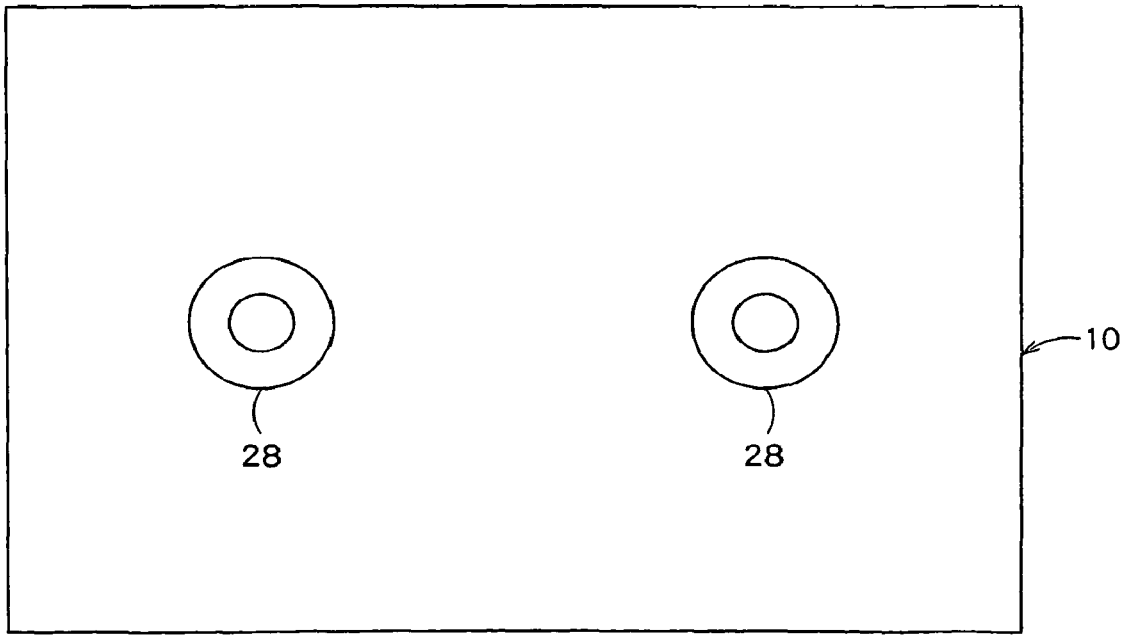
FIG. 6 is a bottom view of the ink jet unit of the ink jet recording apparatus shown in FIG. 1.

As shown in FIG. 1, on a loading surface 115 of the cradle unit 100 whereon the ink jet unit 10 is loaded, a pair of projections 111 are installed. On the other hand, as shown in FIG. 6, on the bottom of the ink jet unit 100, a pair of concavities 28 into which the pair of projections 111 are fit are formed. The pair of projections 111 are fit into the pair of concavities 28, thus the ink jet unit 10 is positioned to and loaded on the cradle unit 100.

The ink injection needles 105 and waste liquid ejection needle 106 aforementioned are installed on a first movement member 113 moving back and forth according to the swinging operation of an operation lever 112 installed on the front of the cradle unit 100. Further, the power source connector 107 and the interface connector 108 are installed on a second movement member 114 moving back and forth according to the swinging operation of the operation lever 112.

And, when loading and uniting the ink jet unit 10 with the loading surface 115 of the cradle unit 100, firstly, the operation lever 112 is operated to put the first movement member 113 and second movement member 114 into a retracted state. In this state, the concavities 28 of the ink jet unit 10 are fit into the pair of projections 111 of the cradle unit 100 and the ink jet unit 10 is loaded on the loading surface 115 of the cradle unit 100.

Next, the operation lever 112 is operated to move forward the first movement member 113 and second movement member 114 and the ink injection needles 105, waste liquid ejection needle 116, power source connector 107, and interface connector 108 are connected to the back of the cradle unit 100. By doing this, the operation of uniting the ink jet unit 10 with the cradle unit 100 is completed.

Further, as shown in FIG. 1, the cradle unit 100 has a unification detection means 117 for detecting that the ink jet unit 10 is united with the cradle unit 100. The unification detection means 117 is composed of a push-button type switch operated when the first movement member 113 moves forward by an operation of the operation lever 112 and is pressed against the back of the ink jet unit 10.

Figure 7:
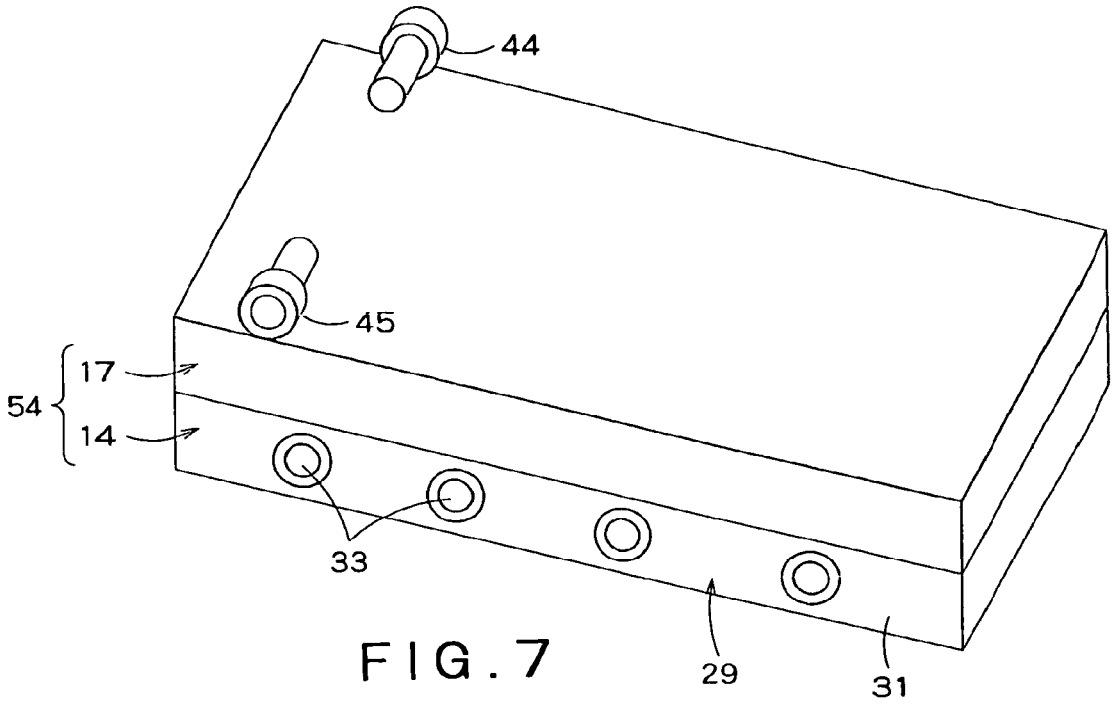
FIG. 7 is a perspective view showing a cartridge having the ink container of the embodiment of the present invention, which is a drawing viewed in the direction in which an ink injection port of the ink container can be seen.
Figure 8:
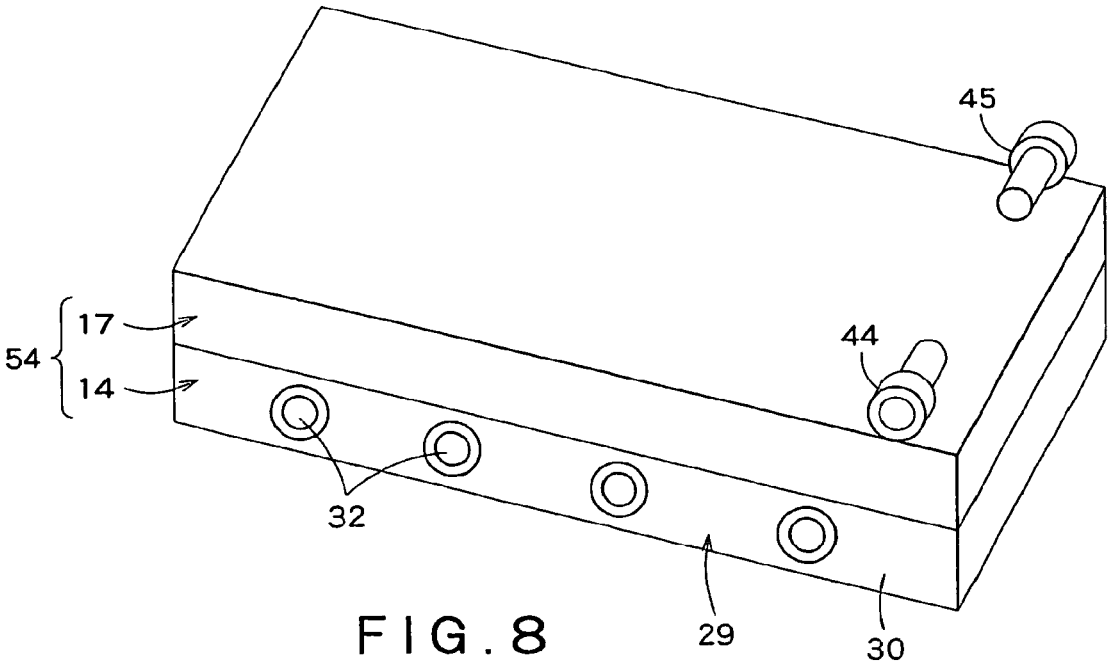
FIG. 8 is a perspective view showing the cartridge having the ink container of the embodiment of the present invention, which is a drawing viewed in the direction in which an ink feed port of the ink container can be seen.

As shown in FIGS. 7 and 8, in this embodiment, the ink container 14 and the waste liquid collection container 17 are united with each other to form a cartridge 54 and the cartridge 54 is removably mounted on the cartridge mounting portion of the ink jet unit 10.

Figure 9:
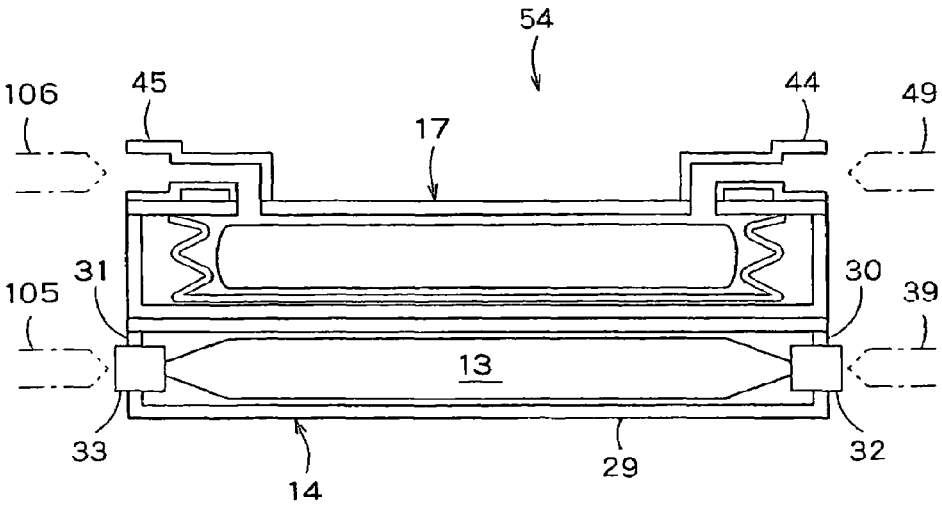
FIG. 9 is a sectional view showing the cartridge having the ink container of the embodiment of the present invention.

As shown in FIGS. 7 to 9, the ink container 14 has a container body 29 involving the storage 13 for storing ink. To a pair of opposite walls 30 and 31 composing a part of the container body 29, a plurality of ink feed ports 32 and a plurality of ink injection ports 33 are respectively fixed. The ink feed port 32 and ink injection port 33 compose a pair of liquid flow ports of the present invention.

Figure 5:
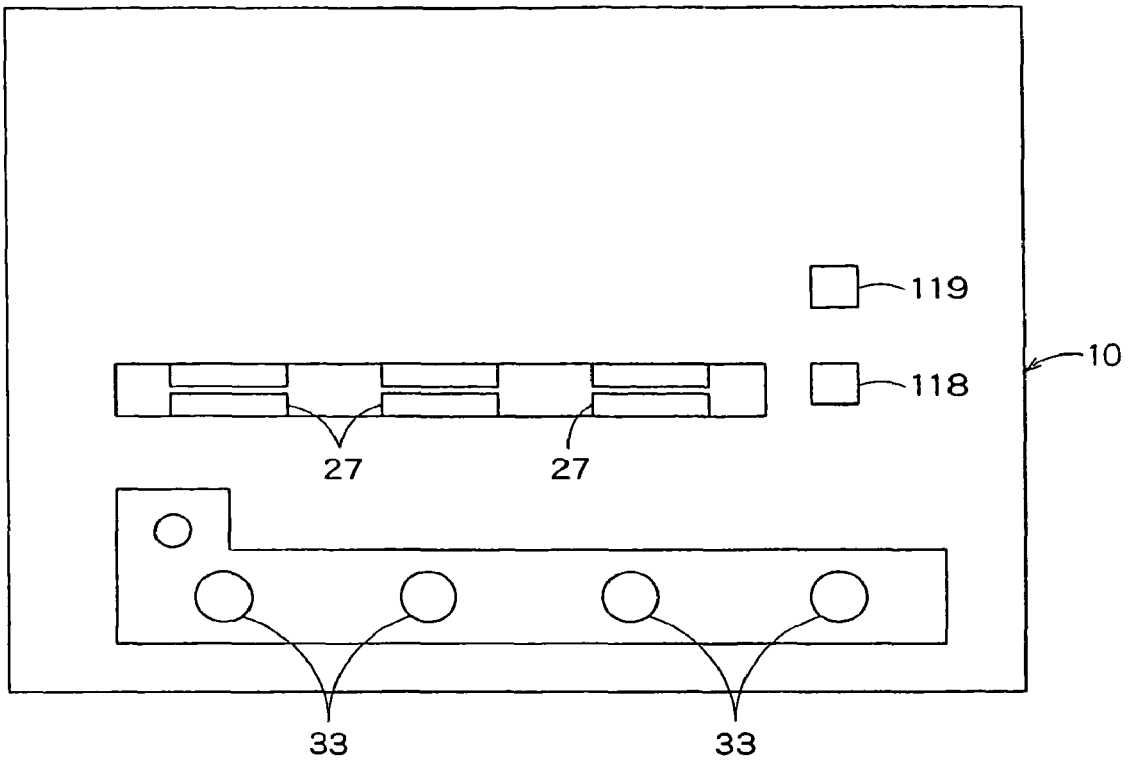
FIG. 5 is a rear view of the ink jet unit of the ink jet recording apparatus shown in FIG. 1.

As shown in FIG. 5, the ink injection ports 33 are exposed on the back of the ink jet unit 10. When the ink jet unit 10 is loaded and united with the cradle unit 100, the ink injection needles 105 of the cradle unit 100 are inserted into the ink injection ports 33, thus the storage space 13 of the container body 29 and the recording head 12 are interconnected with each other for a fluid communication.

The ink feed ports 32 and ink injection ports 33 are respectively arranged on the opposite walls 30 and 31, so that the connection surface (the wall 30) of the ink container 14 for the ink jet unit 10 and the connection surface (the wall 33) of the ink container 14 for the cradle unit 100 are respectively positioned on the opposite sides. Therefore, the ink container 14 mounted on the ink jet unit 10 can be smoothly connected to the cradle unit 100.

The ink tank connection means aforementioned is composed of the ink injection ports 33 of the ink container 14 and the ink injection needles 105 of the cradle unit 100.

It is preferably possible to form the inside of the container body 29 as a closed space, send a compressed fluid (compressed air, etc.) into the closed space, thereby ensure the ink pressure for supplying ink to the recording head 12.

In the ink jet recording apparatus 1, the projections 111 on the loading surface 115 and ink injection needles 105 of the cradle unit 100 are fit into the concavities 28 and ink injection ports 33 on the side of the cradle unit 10, thus the ink jet unit 10 is fixed to the cradle unit 100. Further, an additional fixing means for connecting the body casing of the ink jet unit 10 and the body casing of the cradle unit 100 may be installed.

Figure 10:
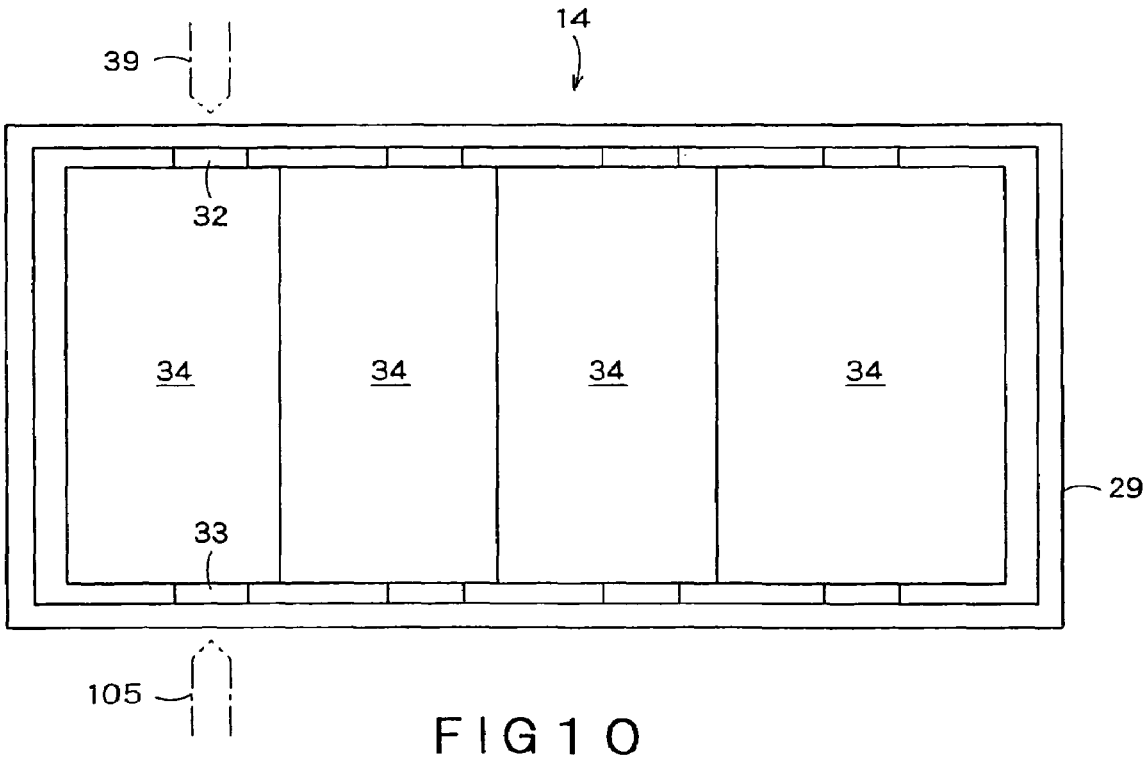
FIG. 10 is a plan view showing the condition that the top of the ink container of the embodiment of the present invention is opened.
Figure 11:
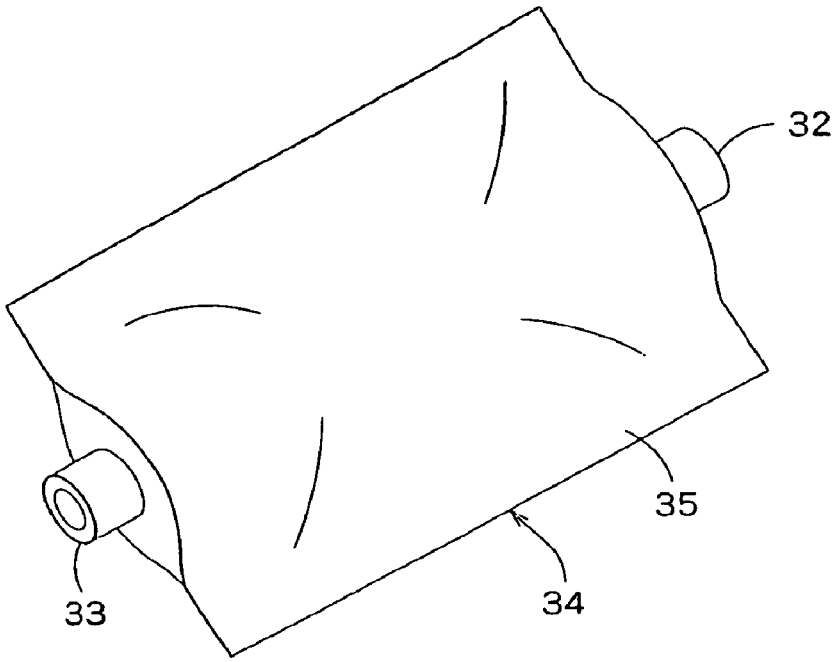
FIG. 11 is a perspective view showing an ink storage member of the ink container of the embodiment of the present invention.

As shown in FIG. 10, inside the container body 29 of the ink container 14, a plurality of ink storage members 34 are stored. As shown in FIG. 11, each ink storage member 34 has a flexible ink storage bag 35, and the ink storage space 13 is formed inside the ink storage bag 35. The ink feed ports 32 and ink injection ports 33 are respectively attached to the front and back ends of the ink storage bags 35.

As clearly shown in FIG. 10, each of the ink injection ports 33 is arranged on the axis of the insertion direction of an ink feed needle 39 into the ink feed port 32. The ink feed ports 32 and ink injection ports 33 are arranged on the same axis like this, so that when the ink injection needles 105 are inserted into the ink injection ports 33, no force for rotating the container body 29 will be exerted. Therefore, on the ink feed ports 32 and the ink feed needles 39 inserted therethrough, no undesirable force will be exerted and the liquid-tightness of the ink feed ports 32 will not be obstructed.

Figure 12:
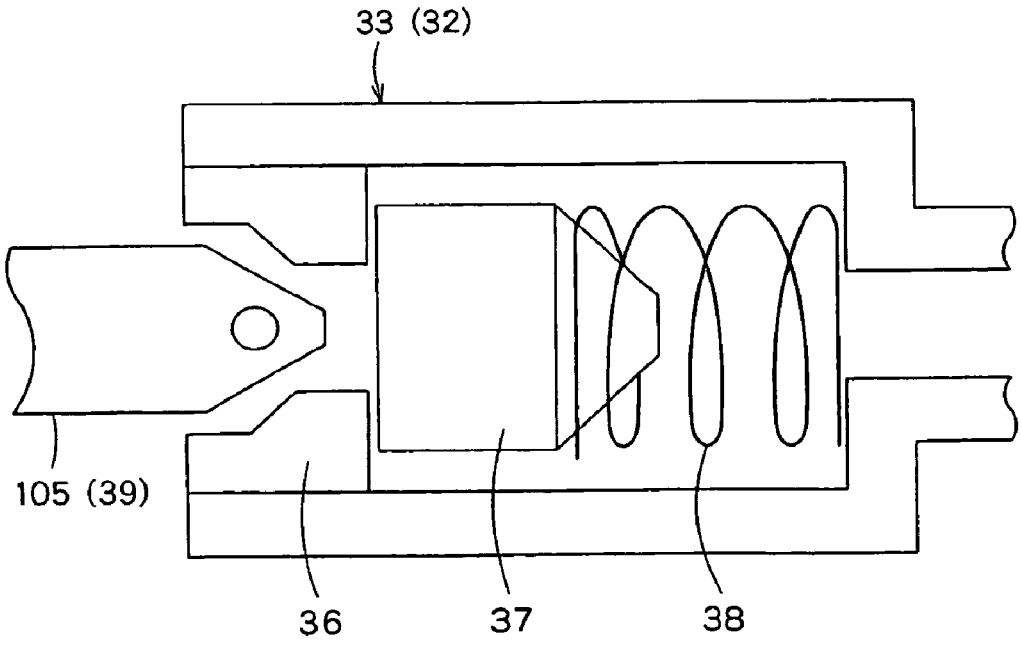
FIG. 12 is a sectional view showing an ink injection port (ink feed port) of the ink container of the embodiment of the present invention.

As shown in FIG. 12, each of the ink injection ports 33 of the ink container 14 includes a annular seal member 36 composed of an elastic member, a valve body 37 cooperative with the flat rear end surface of the annular seal member 36 as a valve seat, and a spring member 38 for pressing the valve body 37 toward the annular seal member 36.

The ink injection port 33 having such a constitution, when the ink injection needle 105 of the cradle unit 100 is not inserted, isolates the storage space 13 in the ink container 14 from the outside. Therefore, when the ink jet unit 10 is not united with the cradle unit 100, the storage space 13 in the ink container 14 is kept insolated from the outside.

On the other hand, when the ink injection needle 105 is inserted into the ink injection port 33, the valve body 37 is pushed in, thus the flow path is opened, and via the ink injection needle 105, the ink container 14 and the ink tank 101 are put into the fluid communication state. Therefore, when the ink jet unit 10 is united with the cradle unit 100, the fluid communication state is kept between the storage space 13 in the ink container 14 and the ink tank 101.

Further, in this embodiment, the ink feed port 32 of the ink container 14 has the same structure and dimensions as those of the ink injection port 33 shown in FIG. 12. Namely, the ink container 14 has a constitution having a pair of ink injection ports. Therefore, the ink feed ports 32 and ink injection ports 33 can be formed by common parts.

Further, in this embodiment, the ink container 14 and waste liquid collection container 17 are united with each other to form the cartridge 54, though the ink container 14 and waste liquid collection container 17 may be formed respectively as a separate cartridge.

Figure 13:
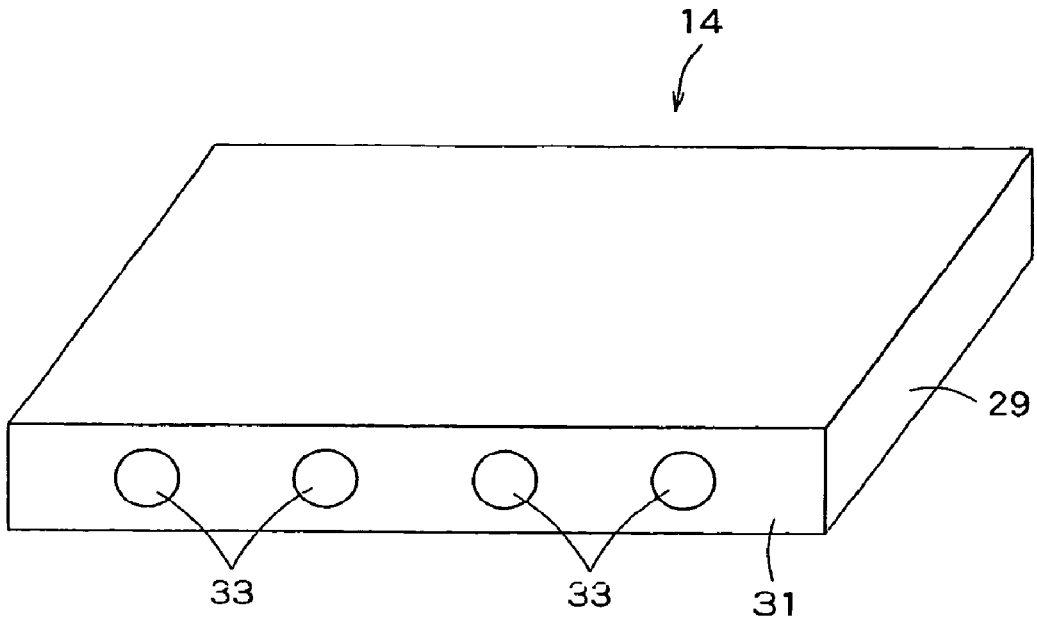
FIG. 13 is a perspective view showing an ink container structured as a cartridge which is separate from a waste liquid collection container as a modification of the embodiment of the present invention, which is a drawing viewed in the direction in which the ink injection port can be seen.
Figure 14:
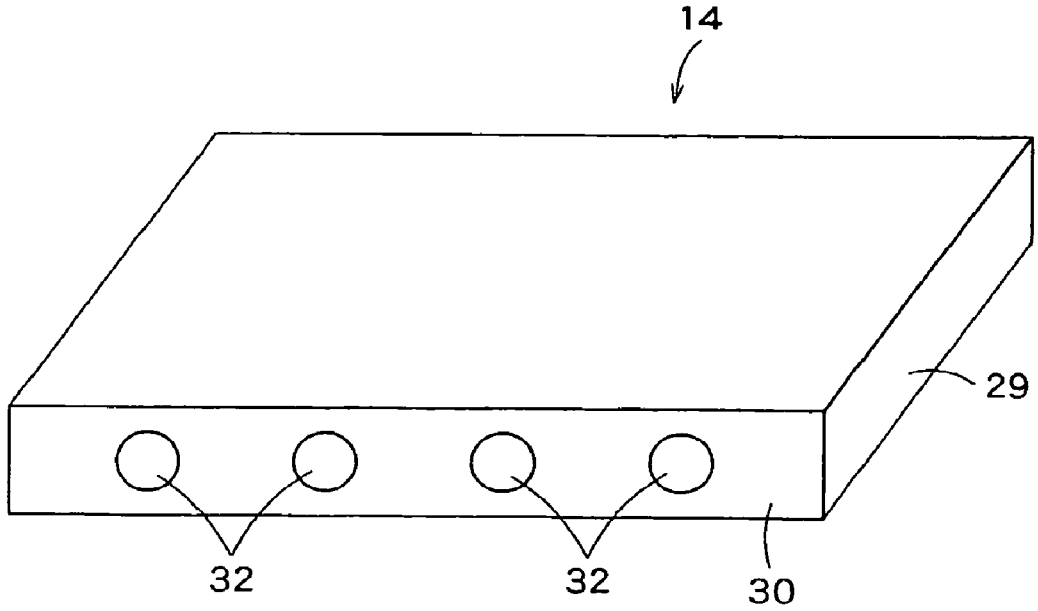
FIG. 14 is a perspective view showing an ink container structured as a cartridge which is separate from a waste liquid collection container as a modification of the embodiment of the present invention, which is a drawing viewed in the direction in which the ink feed port can be seen.

As shown in FIGS. 13 and 14, the ink container 14 formed as a cartridge separate from the waste liquid collection container 17 can be used regardless of its position in terms of the front and rear thereof, when the ink feed ports 32 and ink injection ports 33 are installed respectively in common arrangement on the pair of opposite walls 30 and 31 of the container body 29. Namely, the ink feed port 32 and ink injection ports 33 have the common structure and dimensions to each other, so that when inserting the ink container 14 into the ink jet unit 10, the front/rear direction of the ink container 14 at time of insertion is disregarded. In this case, the ink feed port 32 and ink injection port 33 are not distinguished.

Figure 15:
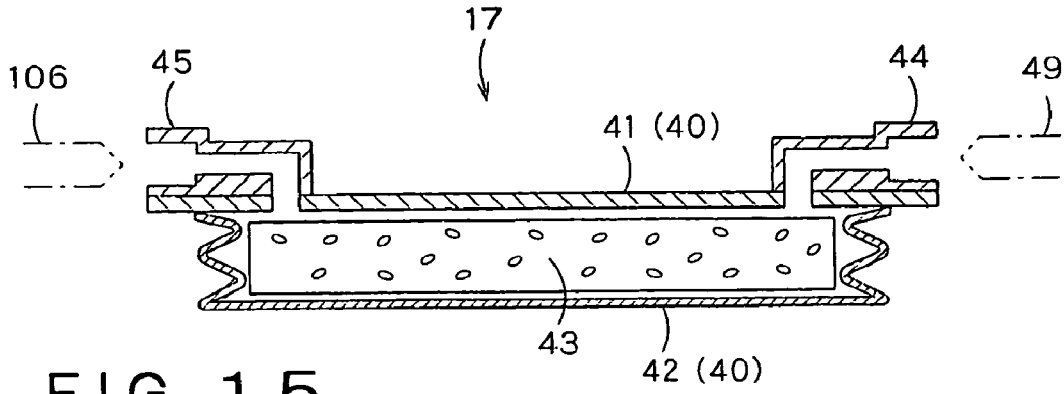
FIG. 15 is a sectional view showing the waste liquid collection container of the ink jet recording apparatus on which the ink container of the embodiment of the present invention is mounted.
Figure 16:
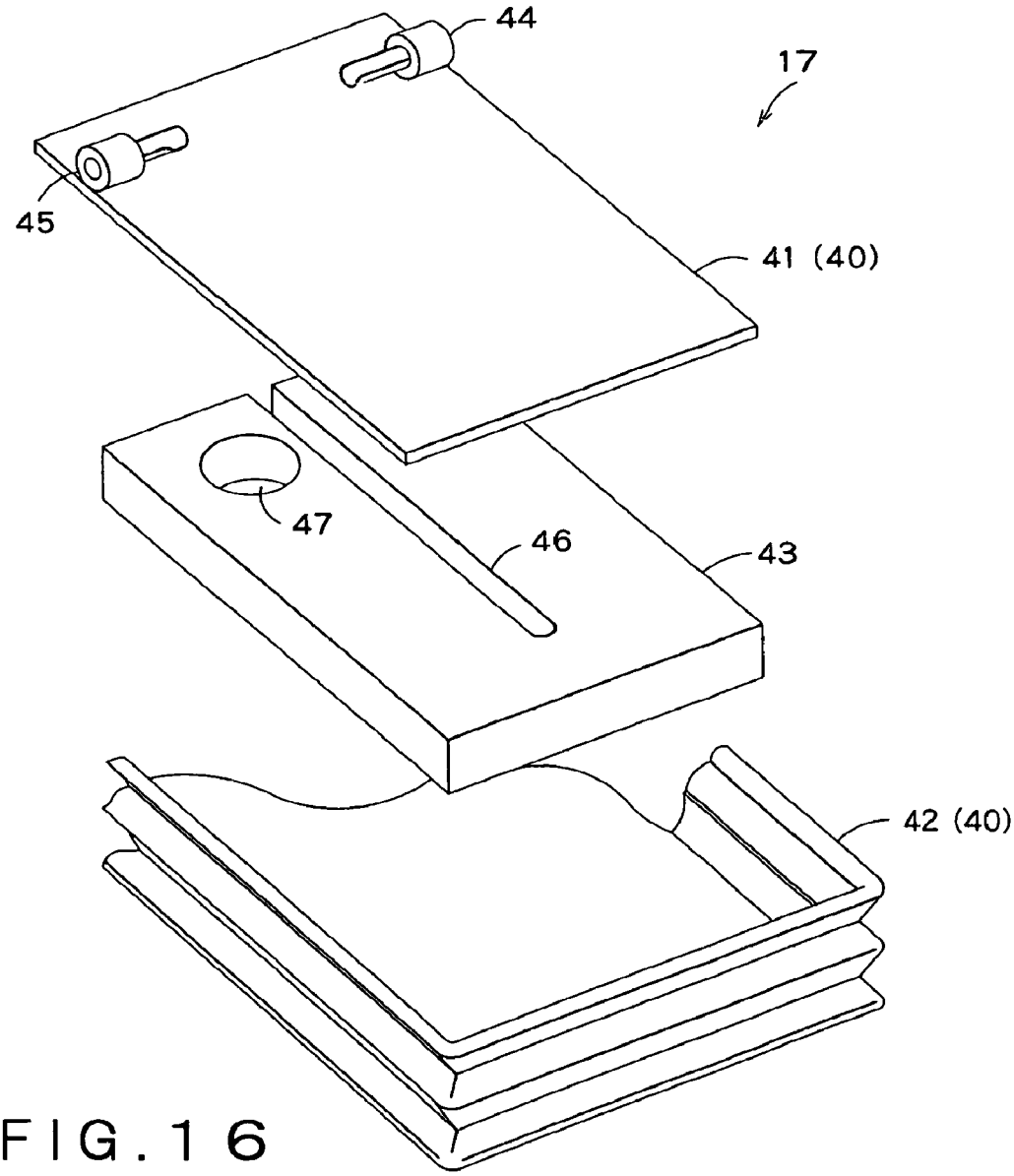
FIG. 16 is an exploded perspective view showing the waste liquid collection container of the ink jet recording apparatus on which the ink container of the embodiment of the present invention is mounted.

As shown in FIGS. 15 and 16, a container body 40 of the waste liquid collection container 17 is composed of a flat cover member 41 made of a rigid member and a pan-shaped member 42 made of a flexible member. In the closed space formed by sealing the top opening of the pan-shaped member 42 with the cover member 41, a flexible ink absorber 43 made of sponge is stored.

On the cover member 41, a waste liquid injection port 44 for injecting a waste liquid sucked and ejected from the recording head 12 into the container body 40 and a waste liquid ejection port 45 for ejecting a waste liquid from the inside of the container body 40 are installed. The waste liquid injection port 44 and waste liquid ejection port 45 are arranged respectively at the opposite positions in the area neighboring with one end of the container body 40 in the longitudinal direction thereof. More concretely, the waste liquid ejection port 45 is arranged on the axis of the insertion direction of a waste liquid injection needle 49 into the waste liquid injection port 44.

The waste liquid ejection port 45 of the waste liquid collection container 17 and the waste liquid ejection needle 106 of the cradle unit 100 compose the waste liquid collection tank connection means aforementioned. The waste liquid injection needle 49 of the ink jet unit 10 is inserted into the waste liquid injection port 44 of the waste liquid collection container 17. At this time, the waste liquid injection port 44 and waste liquid ejection port 45 are arranged on the same axis, so that when inserting the waste liquid ejection needle 106 into the waste liquid ejection port 45, no force for rotating the container body 40 will be exerted. Therefore, on the waste liquid injection port 44 and the waste liquid injection needle 49 inserted therethrough, no undesirable force will be exerted and the liquid-tightness of the waste liquid injection port 44 will not be obstructed.

In the flexible ink absorber 43, a longitudinal slit 46 is formed at the central part in the width direction. The end of the slit 46 on the side neighboring to the waste liquid injection port 44 and waste liquid ejection port 45 is open and the end on the opposite side ends in the middle of the ink absorber 43. A through hole 47 is formed at the position of the ink absorber 43 corresponding to the waste liquid ejection port 45

Figure 17:
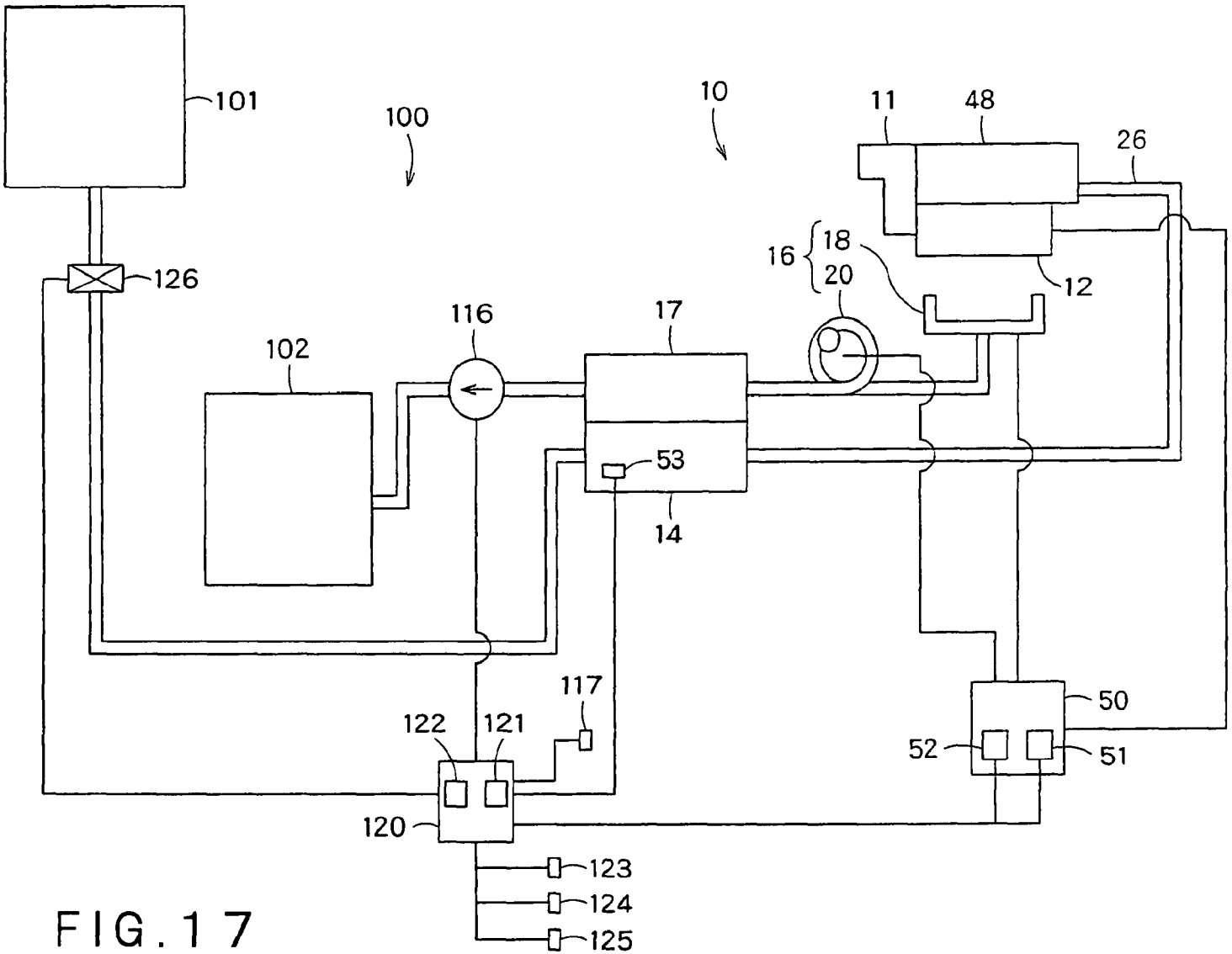
FIG. 17 is a system diagram showing the schematic constitution of the ink jet recording apparatus having the mounted ink container of the embodiment of the present invention.

As shown in FIG. 17, in the cradle unit 100, a waste liquid collection pump 116 is installed in the middle of the flow path interconnecting the waste liquid collection container 17 to the waste liquid collection tank 102. The waste liquid collection pump 116 has a higher ability (capacity) than that of the tube pump 20 installed on the portable ink jet unit 10.

When the waste liquid collection container 17 and the waste liquid collection tank 102 are put into the fluid communication state by the waste liquid collection tank connection means, a waste liquid in the waste liquid collection container 17 can be sucked and forcibly ejected into the waste liquid collection tank 102 by the waste liquid collection pump 116.

As shown in FIG. 17, the ink jet unit 10 has a print control means 50 and the alternating motion of the carriage 11, the injection operation of ink drops from the recording head 12, and the ink suction-ejection operation from the recording head 12 by the ink suction means 16 are controlled by the print control means 50.

Further, the print control means 50 includes a consumption amount storing means 51 for storing the liquid consumption amount in the ink container 14 and an ejection amount storing means 52 for storing the ejection amount of a waste liquid into the waste liquid collection container 17.

The cradle unit 100 has a cradle-side control means 120. The cradle-side control means 120 includes an ink supply control means 121 for controlling the ink supply operation from the ink tank 101 to the ink container 14 and a waste liquid collection control means 122 for controlling the waste liquid collection operation from the waste liquid collection container 17 to the waste liquid collection tank 102.

To the cradle-side control means 120, a supply condition indicator 123 for reporting completion of ink supply to the ink container 14 and a collection condition indicator 124 for reporting completion of collection of a waste liquid in the waste liquid collection container 17 by the waste liquid collection tank 102 are connected.

In the ink container 14, an ink amount detection means 53 for detecting the ink amount in the storage space 13 thereof is installed. The ink amount detection means 53 can detect at least that the storage space 13 of the ink container 14 is full of ink.

The ink supply control means 121, at the point of time when it is detected by the ink amount detection means 53 that the storage space 13 of the ink container 14 is full of ink, closes an ink supply valve 126, stops the ink supply from the ink tank 101 into the ink container 14, and reports by the supply condition indicator 123 that the ink supply to the ink container 14 is completed.

The waste liquid collection control means 122, at the point of time when predetermined time elapses after starting of the waste liquid collection pump 116, stops the waste liquid collection pump 116 and reports by the collection condition indicator 124 that the waste liquid collection from the waste liquid collection container 17 is completed. Or, it is possible to install a means for detecting the liquid amount in the waste liquid collection container 17, stop the waste liquid collection pump 116 on the basis of a signal from the detection means, and operate the collection condition indicator 124.

Next, the ink supply operation and waste liquid collection operation to be performed when uniting the ink jet unit 10 in the portable state with the cradle unit 100 will be explained.

When it is detected by the unification detection means 117 aforementioned that the ink jet unit 10 is united with the cradle unit 100, a detection signal is transmitted to the cradle-side control means 120.

The cradle-side control means 120, when receiving the unification detection signal, starts the ink supply operation and waste liquid collection operation by the ink supply control means 121 and waste liquid collection control means 122.

Namely, the ink supply control means 121, upon receipt of the unification detection signal, opens the ink supply valve 126 which is always kept closed. Then, ink in the ink tank 101 flows into the ink container 14 by the gravity.

And, when it is detected by the ink amount detection means 53 that the ink container 14 is full of ink, the ink supply control means 121 closes the ink supply valve 126 and reports completion of the ink supply by the supply condition indicator 123. At this time, the memory of the consumption amount storing means 51 of the print control means 50 is reset.

The waste liquid collection control means 122, upon receipt of the unification detection signal, operates the waste liquid collection pump 116. Here, at the point of operation time of the waste liquid collection pump 116, the tube pump 20 is put into the non-communication state by the print control means 50 of the ink jet unit 10. Namely, the flexible tube 21 is crushed by the pulley 22 of the tube pump 20 and the flow path blocked state is kept.

When the waste liquid collection pump 116 is operated in the state that the tube pump 20 is kept in the non-communication state like this, the inner pressure of the container body 40 of the waste liquid collection container 17 becomes negative, and the flexible pan-shaped member 42 is deformed in correspondence with ejection of ink from the waste liquid collection container 17. Thereby, the volume of the container body 40 is reduced so that the ink absorber 43 is contracted. By doing this, the ink absorbed and retained by the ink absorber 43 is squeezed and the waste liquid in the waste liquid collection container 17 can be ejected surely.

When predetermined time elapses after starting of the operation of the waste liquid collection pump 116, the crushed state of the flexible tube 21 by the pulley 22 of the tube pump 20 is canceled and the tube pump 20 is put into the communication state.

Hereafter, the waste liquid collection pump 116 is stopped and the suction and ejection operation of a waste liquid from the waste liquid collection container 17 is stopped. At the same time the completion of collection of a waste liquid from the waste liquid collection container 17 into the waste liquid collection tank 102 is reported by the collection condition indicator 124. At this time, the memory of the ejection amount storing means 52 of the print control means 50 is reset.

As mentioned above, in the ink jet recording apparatus on which the ink container 13 according to this embodiment is mounted, the portable ink jet unit 10 can be used independently in the state that it is separated from the cradle unit 100 and can be also used in the state that it is united with the cradle unit 100.

The ink jet unit 10 itself can be miniaturized and reduced in weight as a minimum specification since a large amount of printing can be executed when the ink jet unit 10 is mounted on and united with the cradle unit 100.

Further, since ink is supplied into the ink container of the ink jet unit 10 when the ink jet unit 10 is mounted on the cradle unit 100, a situation of exhaust of ink in the ink container 14 can be prevented when next the ink jet unit 10 is used after being removed from the cradle unit 100.

Similarly, when the ink jet unit 10 is mounted on the cradle unit 100, a waste liquid is collected from the waste liquid collection container 17, so that when next removing and using the ink jet unit 10 from the cradle unit 100, a situation of overflow of a waste liquid from the waste liquid collection container 17 when in use can be prevented.

Further, the same may be said with the battery 15 of the ink jet unit 10. Namely, when the ink jet unit 10 is mounted on the cradle unit 100, the battery 15 is charged, so that when the ink jet unit is next used independently, the battery 15 can be prevented from running down.

When printing in the state that the ink jet unit 10 is mounted on the cradle unit 100, the ink supply control means 121 controls the ink supply valve 126 on the basis of a signal from the ink amount detection means 53 and supplies appropriately ink from the ink tank 101 to the ink container 14.

At this time, the pressure on the ejecting head side is kept constant regardless of the pressure on the ink container side by the pressure regulator 48 installed on the upper part of the recording head 12, so that even if ink is supplied to the ink container 14 during printing, ink will not overflow the recording head 12.

Furthermore, when printing in the state that the ink jet unit 10 is mounted on the cradle unit 100, the ink container 14 functions as the so-called sub-tank, so that ink can be filled up smoothly even during printing at heavy duty. Namely, the ink container 14 in this embodiment, when using independently the ink jet unit 10, functions as a main ink tank, and when mounting and using the ink jet unit 10 on the cradle unit 100, functions as a sub-tank.

Further, even if the removal operation of the ink jet unit 10 from the cradle unit 100 is performed many times so that the annular seal member (elastic member) 36 composing the ink injection ports 33 of the ink container 14 is deteriorated and the leakage resistance is deteriorated, since the ink injection ports 33 are installed in the ink container 14 which is structured as an exchangeable ink cartridge, it is easy to deal with this situation by exchanging the ink container 14.

When the ink jet unit 10 is mounted on the cradle unit 100, the waste liquid collection pump 11 is controlled by the waste liquid collection control means 122 and in place of the tube pump 20 (the tube pump 20 is put into the communication state), ink can be sucked and ejected from the recording head using the waste liquid collection pump 116.

At the time of initial filling of the recording head 12 or at the time of strong suction necessary after long-term non-use, the ink jet unit 10 is mounted on the cradle unit 100 and ink can be sucked and ejected by the waste liquid collection pump 116.

Therefore, the portable ink jet unit 10 does not require a large-capacity pump and the ink jet unit 10 can be miniaturized and reduced in weight. Further, when a large-capacity pump is used, the battery is consumed greatly, thus also from this viewpoint, it is desirable to make the capacity of the pump of the portable ink jet unit 10 smaller.

Further, when the meniscus of the recording head 12 is damaged due to vibration, ink can be sucked by a low-flow speed pump such as the tube pump 20.

In the ink jet recording apparatus 1 in which the cartridge 54 of this embodiment is mounted like this, miniaturization and lightweight which are important factors in a portable apparatus can be realized in the ink jet unit 10, and when the ink jet unit 10 is mounted on the cradle unit 100, an outstanding effect can be obtained that not only a large amount of printing can be performed but also when using next the ink jet unit 10 independently, a sufficient ink amount, waste liquid processing capacity, and battery charging amount can be always ensured.

Further, the ink container 14 according to this embodiment is structured so that the ink feed ports 32 and ink injection ports 33 have the common structure and dimensions and the ink feed ports 32 are paired, so that the ink feed ports 32 and ink injection ports 33 can be formed by common parts. Therefore, as compared with a case of using different kinds of parts, the manufacturing cost can be decreased.

Moreover, the ink feed needles 39 inserted into the ink feed ports 32 and the ink injection needles 105 inserted into the ink injection ports 33 can be formed by common parts, so that the manufacturing cost of the ink jet recording apparatus 1 can be decreased.

Further, in the ink jet recording apparatus 1, the ink container 14 of the ink jet unit 10 is mounted according to the off-carriage system, so that even when the ink injection needles 105 are connected to the ink injection ports 33 of the ink container 14, the alternating motion of the carriage 11 will not be obstructed. Namely, in a case of the on-carriage system instead of the off-carriage system, an ink injection pipe is connected to the ink container loaded on the carriage, so that there is a possibility that the alternating motion of the carriage may be obstructed by the weight and rigidity of the connected pipe. On the other hand, the ink jet recording apparatus 1 adopting the off-carriage system will not cause such a problem.

Figure 18:
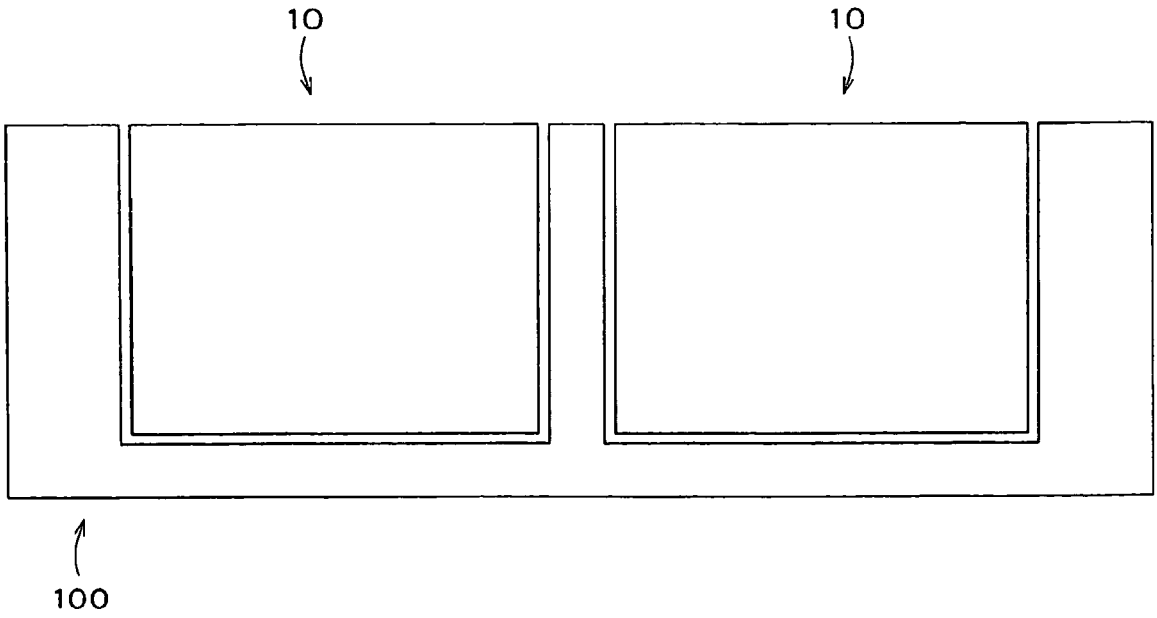
FIG. 18 is a front view showing a modification of the ink jet recording apparatus of the embodiment of the present invention.

Further, as a modification of the ink jet recording apparatus 1, as shown in FIG. 18, the cradle unit 100 can be structured so as to be mounted with a plurality of portable ink jet units 10.

Further, the ink feed needles 39 and the ink injection needles 105 composing a part of the ink tank connection means may have any other forms for permitting ink to flow by connection to the ink feed ports 32, and ink injection ports 33 and are not limited to the needle shape.

Similarly, the waste liquid injection needle 49 and the waste liquid ejection needle 106 composing a part of the waste liquid collection tank connection means may have any other forms for permitting a waste liquid to flow by connection to the waste liquid injection port 44 and waste liquid ejection port 45 and are not limited to the needle shape.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A waste liquid collection container for collecting a waste liquid sucked and ejected from a liquid ejecting head of a liquid ejecting apparatus, comprising:

a container body having at least a part formed by a flexible container wall;

a flexible liquid absorber installed inside said container body;

a waste liquid injection port through which a waste liquid sucked and ejected from said liquid ejecting head is injected into said container body;

a waste liquid ejection port through which a liquid from an inside of said container body is ejected, wherein said waste liquid collection container is structured so that an inner pressure of said container body becomes negative in correspondence with an ejection of said liquid through said waste liquid ejection port, thereby said flexible container wall is deformed and a volume of said container body is reduced so that said liquid absorber is contracted; and wherein said flexible liquid absorber is provided with a through hole at a position corresponding to said waste liquid ejection port.

2. A waste liquid collection container according to claim 1, wherein said waste liquid ejection port is arranged on an axis of an insertion direction of a waste liquid injection needle into said waste liquid injection port.

3. A waste liquid collection container according to claim 1, wherein said waste liquid collection container is structured as a cartridge removably mounted on said liquid ejecting apparatus.

4. A cartridge comprising:

a waste liquid collection container as defined in claim 3; and a liquid container united with said container body of said waste liquid collection container, said liquid container having a container body internally storing a liquid to be fed to said liquid ejecting head.

5. A waste liquid ejection method of ejecting a waste liquid inside a waste liquid collection container as defined in claim 1, comprising:

sucking said inside of said container body through said waste liquid ejection port in a state that a flow path on a side of said waste liquid injection port is blocked so as to make said inner pressure of said container body negative; and contracting said flexible liquid absorber so that a waste liquid is ejected from said inside of said container body through said waste liquid ejection port.

* * * * *